US011415315B1

(12) United States Patent
Roychoudhury et al.

(10) Patent No.: US 11,415,315 B1
(45) Date of Patent: Aug. 16, 2022

(54) TWO-STAGE COMBUSTOR

(71) Applicant: PRECISION COMBUSTION, INC., North Haven, CT (US)

(72) Inventors: Subir Roychoudhury, Madison, CT (US); Richard Mastanduno, Milford, CT (US); Bruce Crowder, Hamden, CT (US); Francesco Macri, Farmington, CT (US)

(73) Assignee: PRECISION COMBUSTION, INC., North Haven, CT (US)

( * ) Notice: Subject to any disclaimer, the term of this patent is extended or adjusted under 35 U.S.C. 154(b) by 306 days.

(21) Appl. No.: 16/798,565

(22) Filed: Feb. 24, 2020

Related U.S. Application Data

(60) Provisional application No. 62/813,785, filed on Mar. 5, 2019.

(51) Int. Cl.
*F23D 14/16* (2006.01)
*F23C 13/02* (2006.01)
(Continued)

(52) U.S. Cl.
CPC ..... *F23C 13/02* (2013.01); *F02G 3/02* (2013.01); *F23C 13/08* (2013.01); *F23C 99/006* (2013.01);
(Continued)

(58) Field of Classification Search
CPC ..... F23C 99/006; F23C 13/02; F23C 13/08; F23D 14/145; F23D 14/18; F23D 14/14; F23D 2212/10; F23D 2212/20; F02G 3/02
(Continued)

(56) References Cited

U.S. PATENT DOCUMENTS 4,027,476 A * 6/1977 Schmidt ..... F01N 3/2846 60/299
5,051,241 A * 9/1991 Pfefferle ..... F01N 3/2835 422/174
(Continued)

FOREIGN PATENT DOCUMENTS

WO WO2004060546 A1 7/2004
WO WO2008048353 A2 4/2008
WO WO2012106048 A1 8/2012

OTHER PUBLICATIONS

Co-Pending U.S. Appl. No. 16/798,630, filed Feb. 24, 2020, entitled "Two-Stage Combustor for Thermophotovoltaic Generator," Applicant: Precision Combustion, Inc.

*Primary Examiner* — Avinash A Savani
(74) *Attorney, Agent, or Firm* — Marie Zuckerman; Andrew D. Gathy

(57) ABSTRACT

A two-stage combustor having as constituent parts: a partial oxidation reactor, which catalytically converts a hydrocarbon fuel and a first supply of oxidant into a gaseous partial oxidation product; and a deep oxidation reactor having a premixer plenum fluidly connected to a porous heat spreader, which converts the gaseous partial oxidation product to deep oxidation products. In one embodiment, the premixer plenum provides an empty space wherein combustion occurs in flame mode. In a second embodiment, the premixer plenum contains a high pore density foam matrix, absent catalyst, which facilitates holding a flameless combustion downstream within the porous heat spreader. In both embodiments heat produced during combustion is transmitted from the heat spreader to an associated heat acceptor, such as a heater head of a Stirling engine.

19 Claims, 5 Drawing Sheets

Figure 1:
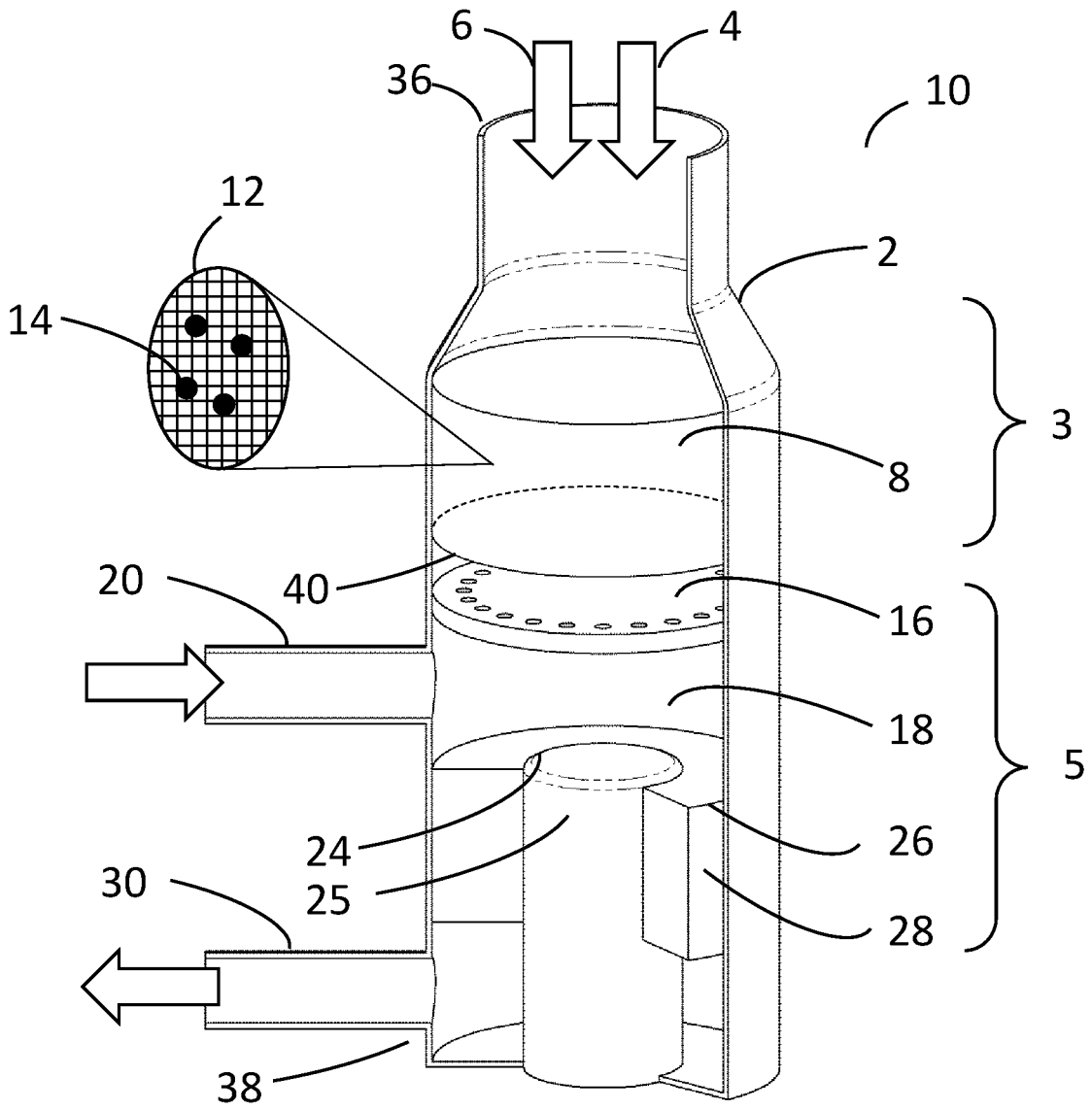

(51) Int. Cl.

| | |
|---|---|
| ***F02G 3/02*** | (2006.01) |
| ***F23D 14/18*** | (2006.01) |
| ***F23C 13/08*** | (2006.01) |
| ***F23D 14/14*** | (2006.01) |
| ***F23C 99/00*** | (2006.01) |

(52) U.S. Cl.
CPC ..... *F23D 14/14* (2013.01); *F23D 14/145* (2013.01); *F23D 14/18* (2013.01); *F23D 2212/10* (2013.01); *F23D 2212/20* (2013.01)

(58) Field of Classification Search
USPC ..... 431/329
See application file for complete search history.

(56) References Cited

U.S. PATENT DOCUMENTS

| | | | | |
|---|---|---|---|---|
| 6,270,336 | B1 * | 8/2001 | Terashima | F23C 13/08 431/11 |
| 8,784,515 | B2 * | 7/2014 | Roychoudhury | C01B 3/386 48/212 |
| 8,795,398 | B2 | 8/2014 | Roychoudhury | |
| 9,903,585 | B1 | 2/2018 | Crowder | |
| 10,001,278 | B1 | 6/2018 | Roychoudhury | |
| 2003/0000145 | A1 | 1/2003 | Salemi | |
| 2008/0078175 | A1 | 4/2008 | Roychoudhury | |
| 2009/0113889 | A1 | 5/2009 | Roychoudhury | |
| 2010/0126165 | A1 | 5/2010 | Roychoudhury | |
| 2011/0146264 | A1 | 6/2011 | Roychoudhury | |
| 2011/0165300 | A1 | 7/2011 | Roychoudhury | |

* cited by examiner

TWO-STAGE COMBUSTOR

CROSS-REFERENCE TO RELATED APPLICATIONS

This application claims the benefit of U.S. provisional patent application No. 62/813,785, filed Mar. 5, 2019.

GOVERNMENT RIGHTS

This invention was made with support from the U.S. government under Contract No. DE-AR0000604, sponsored by the Department of Energy. The U.S. Government holds certain rights in this invention.

FIELD OF THE INVENTION

This invention pertains to a combustor apparatus for burning a hydrocarbon fuel with an oxidant for the purpose of producing a clean and durable combustion process while providing heat efficiently to a downstream application, for example, a heater head of an external combustion engine.

BACKGROUND OF THE INVENTION

Stable, non-catalytic combustion of a hydrocarbon fuel, like natural gas, at ambient pressure in a single stage combustor requires a near-stoichiometric ratio of the oxidant relative to the hydrocarbon fuel. The term "stoichiometric ratio" refers herein to an exact ratio of moles of oxidant to moles of hydrocarbon fuel that are required to convert all of the fuel to complete (or deep) oxidation products, namely, carbon dioxide and water. For methane, the stoichiometric ratio equals 2 moles molecular oxygen ($O_2$) per mole methane ($CH_4$). "Near-stoichiometric" molar ratios for methane combustion could range from about 1.6 moles molecular oxygen per mole methane (1.6:1) to about 2.4:1, which ratios correlate to a phi ($\varphi$) of 0.8:1 to about 1.2:1, where phi compares the actual molar ratio employed to the stoichiometric ratio. Such high ratios of oxidant to fuel result in a flame temperature exceeding 1,200° C., which is too hot for most metallic materials of construction. Under those circumstances, the combustor is required to be constructed from ceramic materials capable of withstanding the higher temperatures, but potentially more fragile and less efficient in transferring heat to a downstream application, such as the heater head of an external combustion engine (e.g., Stirling engine).

Moreover, while combustion in the presence of a catalyst in a single stage combustor is useful in promoting complete conversion of the fuel and improved selectivity to deep oxidation products, catalyst lifetime is greatly reduced in an oxidizing environment at temperatures exceeding 1,200° C. Generally, catalyst lifetime is lengthened as temperature decreases. Moreover, at temperatures exceeding 1,200° C. the catalyst may be lost through volatilization.

In view of the above, it would be desirable to design an improved combustor apparatus that provides for a clean and complete combustion of a hydrocarbon fuel at about ambient pressure and at a temperature less than about 1,400° C. The combustor should provide for complete combustion of the hydrocarbon fuel into a mixture of carbon dioxide and water with minimal, if any, emissions of NOx and hydrocarbons. The design should accommodate a variety of materials of construction depending upon operating temperature. At combustion temperatures up to about 1,200° C., for example, the combustor should be constructed desirably from a metallic material or cermet, so as to provide for durability and efficient heat transfer. Above about 1,200° C., the combustor should be constructed from a durable ceramic material. If such a combustor were to employ an oxidation catalyst for improved conversion and selectivity, then under operating conditions the catalyst should exhibit an acceptable durability with little if any volatilization as well as exhibiting an acceptable lifetime before requiring replacement. Finally, in order to provide further improvements, the design should incorporate specific structural features for transferring heat in an efficient manner to any downstream application, such as to the heater head of an external combustion engine (e.g. Stirling engine), without undue losses of heat to the surrounding environment.

SUMMARY OF THE INVENTION

In one aspect, this invention provides for a two-stage combustor comprising a housing having disposed therein:

(a) a partial oxidation reactor comprising the following components:

(i) a fuel inlet, (ii) a first oxidant inlet, (iii) a partial oxidation reaction zone comprising a porous substrate having a partial oxidation catalyst supported thereon, the partial oxidation reaction zone being disposed in fluid communication with the fuel inlet and first oxidant inlet, and (iv) an outlet fluidly connected to the reaction zone; and (b) a deep oxidation reactor comprising the following components:

(i) a premixer plenum having an upstream end and a downstream end; wherein at the upstream end the premixer plenum is fluidly connected to the outlet of the partial oxidation reactor; and further wherein the premixer plenum comprises a second oxidant inlet;

(ii) a porous heat spreader having an upstream end and a downstream end; wherein at the upstream end the porous heat spreader is fluidly connected to the downstream end of the premixer plenum; the porous heat spreader being capable of retaining combustion therein and transmitting heat to a heat acceptor;

(iii) an outlet pathway fluidly connected to the downstream end of the porous heat spreader.

The two-stage combustor of this invention functionally splits the combustion of a hydrocarbon fuel into two process segments. A first stage of the combustor comprises a partial oxidation reactor wherein under operating conditions a catalytic partial oxidation (POX) occurs, such that a hydrocarbon fuel is partially oxidized into a gaseous partial oxidation product comprising predominantly carbon monoxide and hydrogen. A second stage of the combustor comprises a deep oxidation reactor wherein under operating conditions complete combustion occurs, either catalytically or non-catalytically, so as to convert the gaseous partial oxidation product cleanly into complete oxidation products of carbon dioxide and water with low levels of undesirable emissions. Moreover, heat generated in the two-stage combustor is efficiently transferred to a heat spreader and thereafter to a downstream heat acceptor.

Several advantages accrue from the two-stage combustor design of this invention. In one advantageous embodiment, the catalyst is disposed within the partial oxidation reactor; whereas the deep oxidation reactor does not contain a catalyst. Suitable partial oxidation catalysts, including those of the noble metal family, are able to withstand temperatures of catalytic partial oxidation processes, which are generally less than 1,200° C. and, more likely, between 750° C. and about 1,100° C. The CPOX process and its lower operating temperatures provide for catalyst durability and longevity with little, if any, volatilization. Correlated therewith, the second stage deep oxidation reactor is operated non-catalytically allowing for higher temperatures up to 1,400° C. resulting in more complete combustion while avoiding catalyst degradation problems. In a second advantageous embodiment, when both stages are intended to be operated at a temperature less than 1,200° C., an appropriate catalyst can be selected in each of the first and second stages, if desired, to optimize reactions therein.

As another advantage, the generation of hydrogen in the first stage CPOX reactor provides for improved combustion stability in the deep oxidation reactor, while aiding in reducing the operating temperature therein. This advantage allows for use of durable and thermally efficient metallic materials of construction; whereas higher temperatures generally impose a requirement for ceramic materials of construction. Moreover, the combustor of this invention provides for a clean and durable combustion process with little, if any, NOx and undesirable hydrocarbons emissions. As yet another advantage, specific structural features of the apparatus of this invention, notably, the particular structure of the heat spreader, result in efficient heat transfer to a heat acceptor, such as the heater head of an external combustion engine, without undue heat losses to the environment.

In one application, this invention provides for an improved Stirling engine having a piston undergoing reciprocating linear motion within an expansion cylinder containing a working fluid, wherein the working fluid is heated through a heater head. The improvement specifically comprises disposing the heater head in thermal communication with the aforementioned two-stage combustor, which functions to generate heat and transfer said heat to the heater head (heat acceptor) of the Stirling engine.

DRAWINGS

FIG. 1 provides an illustration in isometric view of one embodiment of the apparatus of this invention.

Figure 2:
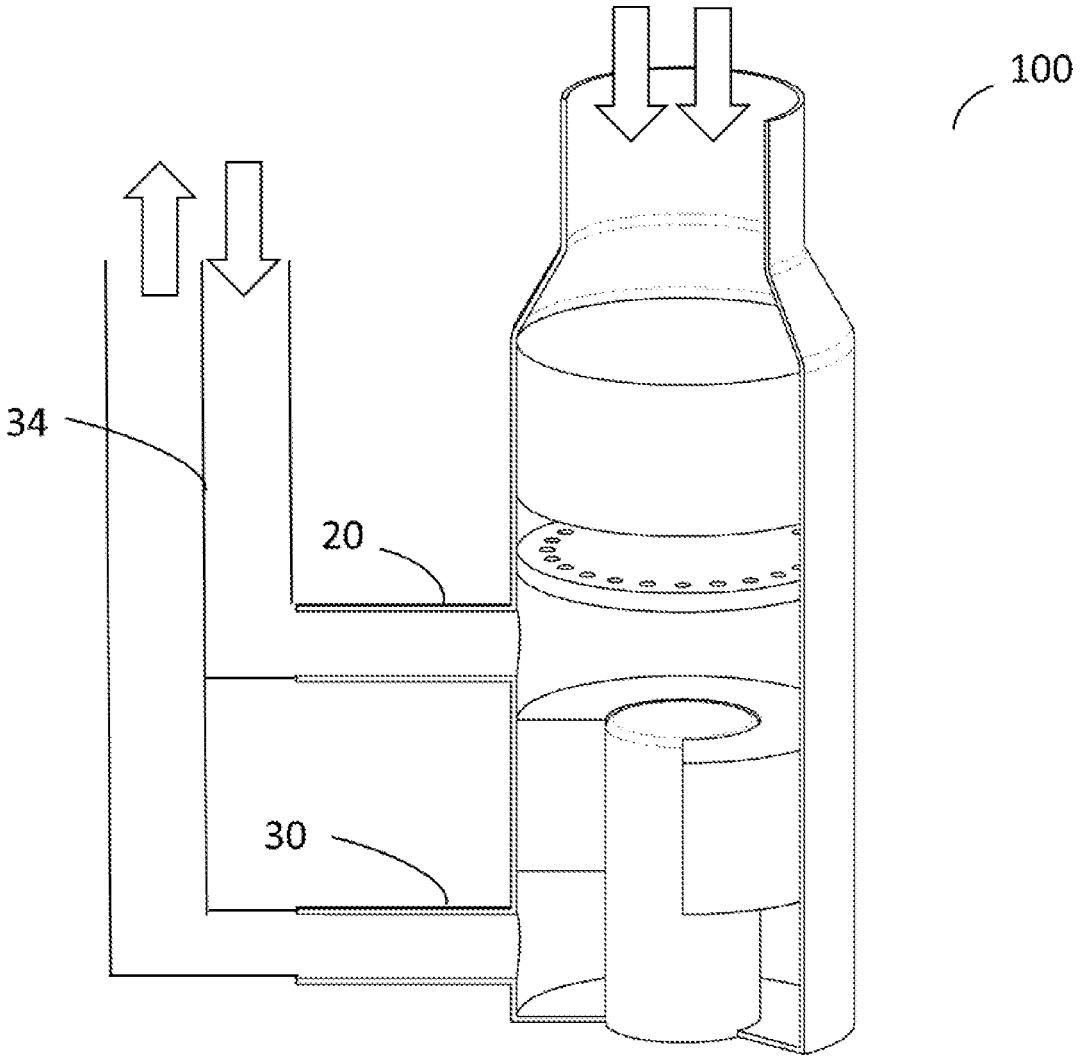

FIG. 2 provides an illustration in isometric view of another embodiment of the apparatus of this invention.

Figure 3:
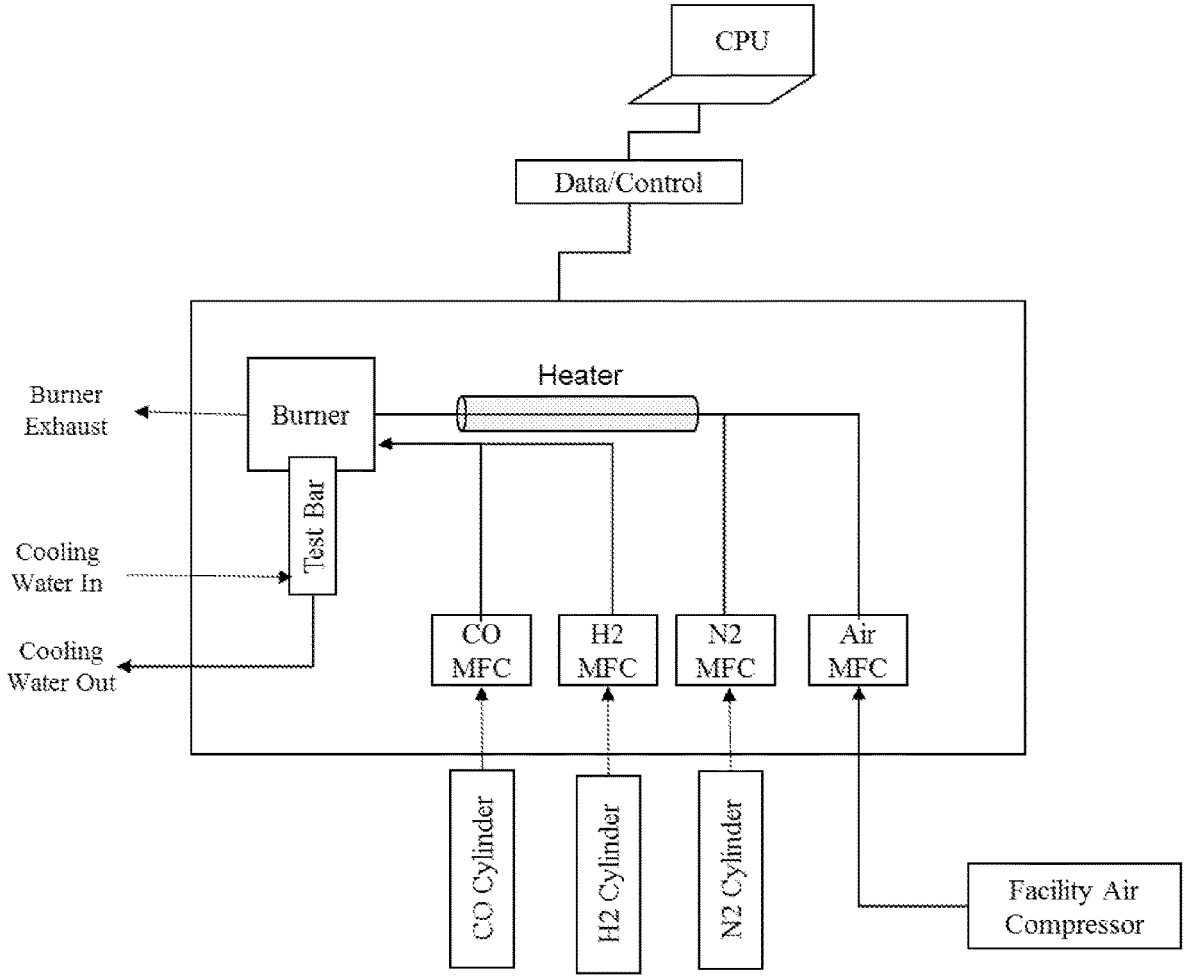

FIG. 3 provides an illustration of an experimental embodiment simulating aspects of the apparatus of this invention.

Figure 4:
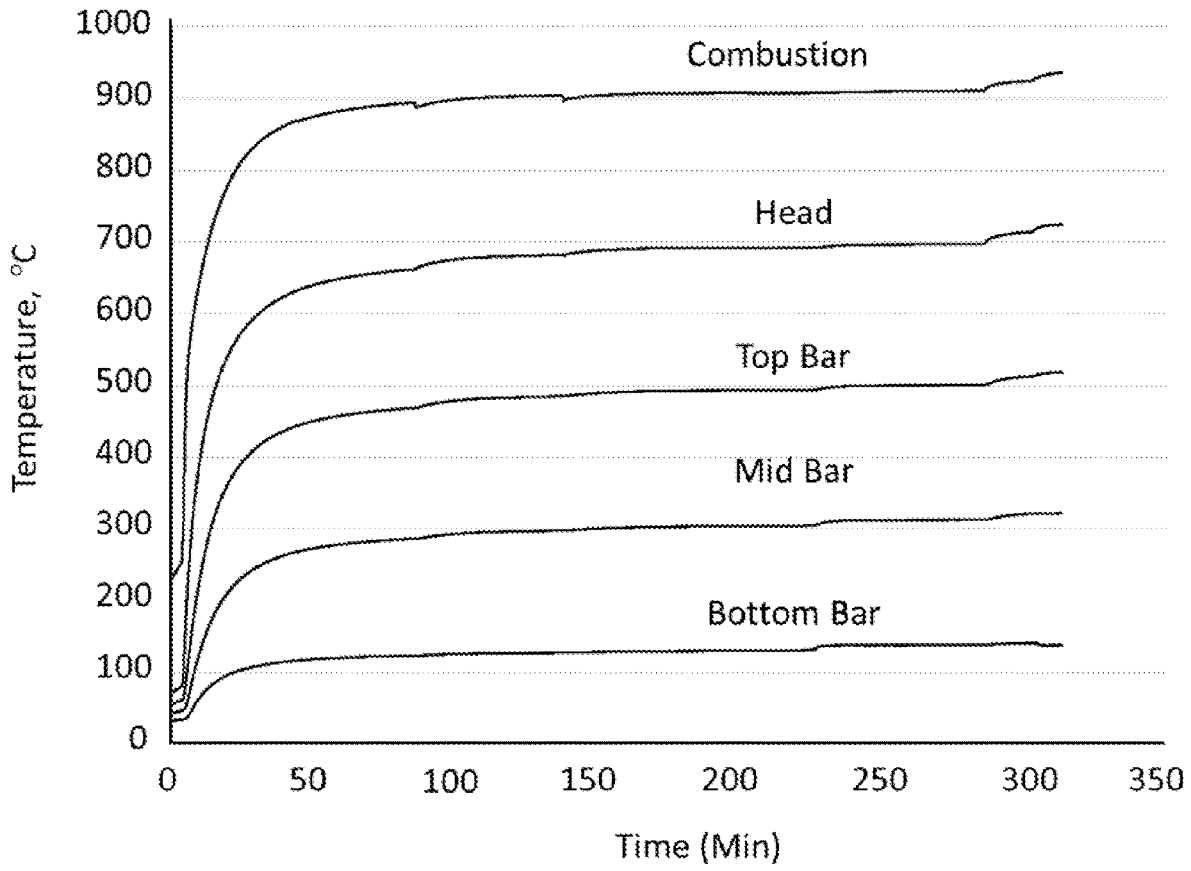

FIG. 4 provides a graph of temperature versus time during operation of the experimental embodiment illustrated in FIG. 3.

Figure 5:
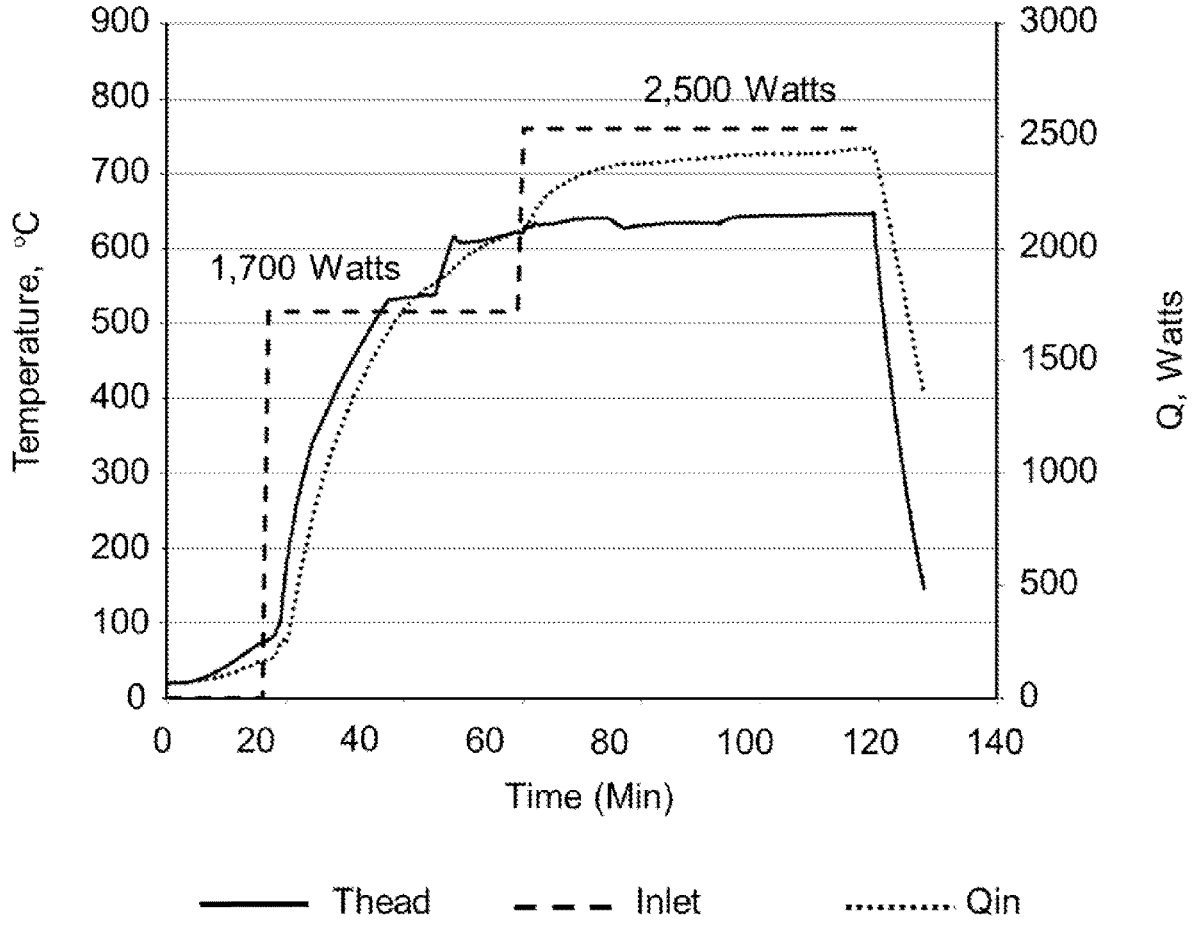

FIG. 5 provides a graph of temperature versus time during operation of the apparatus of this invention on a Stirling engine.

DETAILED DESCRIPTION OF THE INVENTION

In one embodiment, this invention provides for a two-stage combustor comprising a housing defining a longitudinal axis and having disposed therein:

(a) a partial oxidation reactor comprising the following components:

(i) a fuel inlet for feeding a hydrocarbon fuel into a partial oxidation reaction zone, (ii) a first oxidant inlet for feeding a first supply of an oxidant into the partial oxidation reaction zone, (iii) the partial oxidation reaction zone comprising a porous mesh substrate having a partial oxidation catalyst supported thereon, the reaction zone being in fluid communication with the fuel inlet and the first oxidant inlet; and (iv) an outlet fluidly connected to the partial oxidation reaction zone for exhausting at least one partial oxidation reaction product; and (b) a deep oxidation reactor comprising the following components:

(i) a premixer plenum having an upstream end and a downstream end; wherein at the upstream end the premixer plenum is fluidly connected to the outlet of the partial oxidation reactor; and further wherein the premixer plenum comprises a second oxidant inlet for feeding a second supply of an oxidant into the premixer plenum;

(ii) a porous heat spreader having an upstream end and a downstream end; wherein at the upstream end the porous heat spreader is fluidly connected to the downstream end of the premixer plenum; the porous heat spreader comprising a foam matrix capable of retaining combustion therein and transmitting heat downstream to a heat acceptor; and (iii) an outlet pathway fluidly connected to the downstream end of the porous heat spreader for exhausting a gaseous deep oxidation product.

The term "upstream end", as used herein, signifies a side of a specified component in the two-stage combustor wherein a fluid flow enters the component. The term "downstream end" signifies a side of a specified component in the two-stage combustor wherein a fluid flow exits the component. In one embodiment, fluids flow through the two-stages of the combustor in a direction parallel to the longitudinal axis of the combustor from the inlets of the catalytic partial oxidation reactor to the outlet of the deep oxidation reactor. It should be appreciated, however, that other operable flow patterns can be envisioned by the person of skill in the art.

In another embodiment, the foam matrix of the heat spreader is provided in an annular shape defined by an inner diameter and an outer diameter.

In another related embodiment, under operating conditions, heat transmitted to and generated within the deep oxidation reactor is transferred radially inward into a heat acceptor disposed within a cylindrical volume defined by the length and the inner diameter of the annular-shaped heat spreader. The two-stage combustor is insulated appropriately to facilitate heat transfer in a radially inward direction. Notably, interior surfaces of the combustor housing are lined with a thermal insulator material. In one embodiment, the heat acceptor comprises the heater head of a Stirling engine.

In one embodiment, the deep oxidation reactor does not comprise a catalyst; accordingly, the combustion process occurring within the deep oxidation reactor functions non-catalytically, which allows for operating temperatures up to 1,400° C. By avoiding the use of a catalyst in the deep oxidation reactor where temperatures are at their highest, the apparatus avoids the problems of catalyst degradation including catalyst volatilization and loss of catalyst lifetime.

In another embodiment, the deep oxidation reactor comprises an oxidation catalyst, and the combustion process occurring within the deep oxidation reactor functions catalytically. Such an embodiment is intended for use at temperatures typically not exceeding 1,200° C., and preferably, not exceeding 900° C.

In one embodiment, the premixer plenum does not contain a foam matrix. In this embodiment, functionally, a non-catalytic combustion occurs with a diffusion flame stabilized within the premixer plenum.

In another embodiment, the premixer plenum contains a high density foam matrix, the density thereof being higher than the density of the foam matrix provided as the heat spreader. In this embodiment, functionally, a non-catalytic flameless combustion is stabilized within the foam matrix of the heat spreader.

The invention is further described and illustrated in the following figures and embodiments. Reference is made to FIG. 1 illustrating an embodiment 10 of the two-stage combustor apparatus of this invention. The apparatus comprises a housing 2, essentially of cylindrical structure, extending along a longitudinal axis and having an upstream end 36 and a downstream end 38 defining under process conditions a flow of fluids. The housing 2 is structurally and functionally divided into a partial oxidation reactor 3 disposed upstream of a deep oxidation reactor 5. The partial oxidation reactor 3 is fitted with a fuel inlet 4 for feeding a fuel into a partial oxidation reaction zone 8 and a first oxidant inlet 6 for feeding a supply of a first oxidant into the partial oxidation reaction zone 8, which itself comprises a mesh substrate 12 having a partial oxidation catalyst 14 supported thereon. The downstream end 40 of the partial oxidation reactor 3 provides an outlet for the at least one partial oxidation product, of which carbon monoxide and hydrogen are preferred.

Further to FIG. 1, the deep oxidation reactor 5 comprises a premixer plenum 18, which at its upstream end is fluidly connected to the outlet 40 of the partial oxidation reactor 3. The premixer plenum 18 is fluidly connected at its downstream end to heat spreader 28. The premixer plenum 18 is further comprised of a second oxidant inlet 20 for feeding a second supply of oxidant into the premixer plenum 18. In FIG. 1 as illustrated, the premixer plenum 18 further comprises at its upstream end a flow distribution plate 16 comprising a plurality of holes. The heat spreader 28 comprises a porous material, for example, a porous foam, which is provided in an annular shape defined in transverse cross-section by an inner diameter 24 and an outer diameter 26. Downstream from the heat spreader 28 is reactor outlet 30 from which deep oxidation gases are exhausted. An interior space 25 bounded by the inner diameter 24 of the annular-shaped heat spreader 28 is available space for locating a heat acceptor, as explained hereinafter.

FIG. 2 illustrates another embodiment 100 of the apparatus of this invention. This embodiment is identical in all aspects to that of FIG. 1, excepting that the reactor outlet 30 and the second oxidant inlet 20 share a common thermally conductive wall 34. Functionally, the wall 34 acts as a recuperator, transmitting heat from the deep oxidation combustion products exiting in line 30 to the incoming second supply of oxidant flowing through oxidant inlet 20.

In the embodiments of the invention illustrated in FIGS. 1 and 2, the heat spreader 28 is depicted in an annular shape bounded by an inner diameter 24 and an outer diameter 26. This shape defines a cylindrical interior space 25 bounded by inner diameter 24 and extending along the length of the heat spreader 28. It should be appreciated that a heat acceptor is intended to be disposed within the cylindrical interior space 25 in thermal communication with the heat spreader 28. In one embodiment, the heat acceptor comprises a heater head of a Stirling engine, the heater head being disposed within space 25, preferably, in solid-to-solid contact or close proximity with the heat spreader 28 so as to facilitate heat transfer from the heat spreader 28 to the heater head. In this design, heat produced by combusting the partial oxidation products within the deep oxidation reactor 5 flows radially inward from the heat spreader 28 into the heat acceptor occupying interior space 25.

Each component of the two-stage combustor apparatus of this invention is constructed from a material capable of withstanding the temperature to which the part is to be exposed. Moreover, each part is designed to maximize heat transfer downstream into an associated heat acceptor, more specifically, a heat acceptor positioned within the interior space (FIG. 1/25) in thermal communication with the heat spreader 28. Typically, the first stage partial oxidation reactor and second stage deep oxidation reactor are combined within a combustor housing that is constructed from a material capable of withstanding temperatures typically up to 1,200° C. in the partial oxidation reactor, and preferably up to 1,400° C. in the deep oxidation reactor, for prolonged periods. Such metals include iron-chromium alloys, including FeCrAlY iron-chromium alloys; nickel-chromium alloys and nickel-chromium-iron alloys, such alloys to include HASTELLOY® brand alloys (Haynes International) including HASTELLOY brand Alloy X ("HastX"), INCONEL® brand alloys (Huntington Alloys, Corp.) including INCONEL brand Alloy 625, INCONEL brand Alloy 718, INCONEL brand Alloy 600, and INCONEL brand Alloy 601, as well as stainless steel. Likewise, the fuel and oxidant inlets to the partial oxidation reactor and the secondary oxidant inlet to the premixer plenum are constructed from any of the aforementioned alloys, but also can be satisfactorily constructed from standard stainless steel or high temperature stainless steel, as dictated by the temperature to which the parts are to be exposed. The combustor housing is typically lined with an insulator at least on its interior surface, so as to minimize losses of combustion heat to the surrounding environment. Suitable insulators include high temperature ceramic fiber insulation, suitable non-limiting examples of which include KAOWOOL® brand ceramic fiber insulation (Thermal Ceramics, Inc.) and high temperature aerogel insulation, such as PYROGEL® brand aerogel insulation (Aspen Aerogels, Inc.). The combustor exhaust outlet (FIG. 1/30), which is exposed to temperatures of about 250° C. to 350° C., typically employs a metallic construction material of suitable thermal durability, including any of the aforementioned alloys. In the embodiment wherein the secondary oxidant inlet (FIG. 2/20) to the premixer plenum shares a common thermally-conductive wall (FIG. 2/34) with the combustor outlet (FIG. 2/30), the wall is typically comprised of a HASTELLOY brand Alloy X, or a FeCrAlY iron-chromium alloys, or stainless steel, any one of which is suitably provided as a thin wall or foil sheet.

The partial oxidation reactor beneficially employed in the process of this invention comprises any one of those partial oxidation (POX) reactors known in the art that provides for conversion of a mixture of the hydrocarbon fuel and the first oxidant into a gaseous partial oxidation product predominantly comprising hydrogen and carbon monoxide. Non-limiting examples of suitable partial oxidation reactors include those described in the following patent documents: U.S. Pat. Nos. 7,976,594, 8,557,189, WO 2004/060546, and US 2011/0061299, incorporated herein by reference.

According to the invention, under operating conditions a hydrocarbon fuel is fed from a fuel supply, such as a fuel tank, through a first inlet pathway into the partial oxidation reactor, preferably, into a mixer within the partial oxidation reactor. The fuel inlet pathway comprises any known inlet device for feeding the hydrocarbon fuel to the partial oxidation reactor, for example, a nozzle, atomizer, vaporizer, injector, mass flow meter, or any other suitable flow control device. The injector also functions to quantify (or meter) the fuel fed to the partial oxidation reactor. Likewise, the first supply of oxidant is fed into the partial oxidation reactor, preferably, into the mixer section of the partial oxidation reactor, through the primary oxidant inlet comprising any conventional inlet device, for example, a nozzle, injector, or mass flow meter capable of feeding the first supply of oxidant into the partial oxidation reactor.

In one embodiment, the mixer of the partial oxidation reactor comprises swirler vanes and baffles to facilitate mixing the hydrocarbon fuel and the first supply of oxidant as well as to facilitate atomization of any liquid fuel, when a liquid fuel is employed. In one other embodiment, the mixer comprises a combination of a pulsed electromagnetic liquid fuel injector and a pulsed oxidant injector, which feed the liquid fuel and the first oxidant, respectively, into an atomizer that thoroughly atomizes the liquid fuel and mixes it with the oxidant. This combined dual injector-atomizer device is described in U.S. Pat. No. 8,439,990, incorporated herein by reference. If a gaseous hydrocarbon fuel is employed, there is no requirement to provide an atomizer.

In one embodiment, the hydrocarbon fuel is fed to the mixer at ambient temperature without preheating. In another embodiment, the hydrocarbon fuel is preheated prior to being fed to the mixer. In the event that a liquid hydrocarbon fuel is employed, we have found that heat generated in the reaction zone of the partial oxidation reactor is sufficient to support liquid fuel vaporization at a level required for stable partial oxidation throughout the partial oxidation catalyst. As a consequence, the partial oxidation reactor and POX process therein are capable of providing gasification of a liquid fuel without a requirement for supplying external heat or steam to the POX reactor. The first supply of oxidant is generally fed into the mixer without preheating, but variations in temperature may be implemented as desired.

The partial oxidation reactor comprises a catalytic reaction zone having disposed therein a porous substrate onto which a partial oxidation catalyst is supported, such porous substrate configured to provide thorough mixing of the fuel and oxidant passing there through. To achieve this goal, in one embodiment the porous substrate is provided as a mesh substrate structured in the form of a reticulated net or screen comprising a plurality of pores or cells or channels. Preferably, the pores, cells, or channels of the porous mesh have an ultra-short-channel-length, as noted hereinafter. In one embodiment the mesh is suitably provided in a coiled configuration of cylindrical shape having an inner diameter and a larger outer diameter such that reactants flowing there through move along a radial flow path from an inlet along the inner diameter to an outlet along the outer diameter of the coil. In another embodiment the mesh is suitably provided as one mesh sheet or a plurality of stacked mesh sheets with a bulk flow from an inlet end of the stack to an outlet end of the stack. In any embodiment, the bulk configuration of the substrate provides for a plurality of void volumes in random order, that is, empty spaces having essentially no regularity along the flow path from the partial oxidation reactor upstream inlets to the partial oxidation reactor downstream outlet.

The porous substrate is typically constructed from any material capable of withstanding the temperature at which the partial oxidation reactor operates, generally, in a range from about 750° C. to about 1,200° C. Such materials include metals and ceramic materials of suitable temperature durability. Suitable metal meshes include, without limitation, those constructed from nickel-chromium-iron alloys, iron-chromium alloys, and iron-chromium-aluminum alloys of the kind previously disclosed herein. The term "ceramic" refers to inorganic non-metallic solid materials with prevalent covalent bonds, including but not limited to metallic oxides, such as oxides of aluminum, silicon, magnesium, zirconium, titanium, niobium, and chromium, as well as zeolites and titanates. Reference is made to U.S. Pat. Nos. 6,328,936 and 7,141,092, detailing insulating layers of ultra-short-channel-length ceramic mesh comprising woven silica, both patents incorporated herein by reference.

In one exemplary embodiment, the porous substrate comprises an ultra-short-channel-length mesh; in a more preferred embodiment thereof a MICROLITH® brand ultra-short-channel-length mesh available from Precision Combustion, Inc., North Haven, Conn., USA. A description of the ultra-short-channel-length mesh is found, for example, in U.S. Pat. No. 5,051,241, incorporated herein by reference. Generally, the mesh comprises short channel length, low thermal mass monoliths, which contrast with prior art monoliths having longer channel lengths. For purposes of this invention, the term "ultra-short-channel-length" refers to a channel length in a range from about 25 microns (μm) (0.001 inch) to about 500 μm (0.02 inch). In contrast, the term "long channels" pertaining to prior art monoliths refers to channel lengths of greater than about 5 mm (0.20 inch) upwards of 127 mm (5 inches). In this invention the term "channel length" is taken as the distance along a pore or channel from inlet to outlet, for example, as measured from an inlet on one side of a sheet of mesh to an outlet on the opposite side of the sheet. (This measurement is not to be confused with the overall length of the flow path through the entire mesh substrate from the upstream inlet of the substrate to the downstream outlet of the substrate.) In another embodiment, the channel length is not longer than the diameter of the elements from which the mesh is constructed; thus, the channel length may range from 25 μm (0.001 inch) up to about 100 μm (0.004 inch) and preferably not more than about 350 μm (0.014 inch). In view of this ultra-short channel length, the contact time of reactants with the mesh and catalyst supported thereon advantageously ranges from about 5 milliseconds (5 msec) to about 350 msec.

The MICROLITH brand ultra-short-channel-length mesh typically comprises from about 100 to about 1,000 or more flow channels per square centimeter. More specifically, each layer of mesh typically is configured with a plurality of channels or pores having a diameter ranging from about 0.25 millimeters (mm) to about 1.0 mm, with a void space greater than about 60 percent, preferably up to about 80 percent or more. A ratio of channel length to diameter is generally less than about 2:1, preferably less than about 1:1, and more preferably, less than about 0.5:1. MICROLITH brand meshes can be manufactured in the form of woven wire screens, woven ceramic fiber screens, pressed metal or ceramic screens; or they can be manufactured by perforation and expansion of a thin metal sheet as disclosed in U.S. Pat. No. 6,156,444, incorporated herein by reference; or alternatively manufactured by 3-D printing or by a lost polymer skeleton method.

The MICROLITH brand mesh having the ultra-short-channel-length facilitates packing more active surface area into a smaller volume and provides increased reactive area and lower pressure drop, as compared with prior art monolithic substrates. Whereas in prior art honeycomb monoliths having conventional long channels where a fully developed boundary layer is present over a considerable length of the channels, in contrast, the ultra-short-channel-length characteristic of the mesh of this invention avoids boundary layer buildup. Since heat and mass transfer coefficients depend on boundary layer thickness, avoiding boundary layer buildup enhances transport properties. Employing the ultra-short-channel-length mesh, such as the MICROLITH brand thereof, to control and limit the development of a boundary layer of a fluid passing there through is described in U.S. Pat. No. 7,504,047, which is a Continuation-In-Part of U.S. Pat. No. 6,746,657 to Castaldi, both patents incorporated herein by reference. The preferred MICROLITH brand of ultra-short-channel-length mesh also advantageously provides for a light-weight portable size, a high throughput, a high one-pass yield of hydrogen-containing partial oxidation product, a low yield of coke and coke precursors, and an acceptably long catalyst lifetime, as compared with alternative substrates including ceramic monolith and pelleted substrates.

In another exemplary embodiment, the porous substrate is constructed of an analogous porous structure of metal or ceramic comprising an interconnected network of solid struts defining a plurality of pores of an open-cell configuration. The pores can have any shape or diameter; but typically, a number of pores that subtend one inch designate a "pore size," which for most purposes ranges from about 5 to about 80 pores per inch. The relative density of such structures, taken as the density of the structure divided by the density of solid parent material of the struts, typically ranges from about 2 to about 15 percent. Manufactured or structured ultra-short-channel-length substrates are commercially available in a variety of materials capable of withstanding the operating temperature of the partial oxidation reactor.

The porous substrate disposed within the partial oxidation reactor supports a catalyst capable of facilitating partial oxidation reactions, wherein a mixture of the hydrocarbon fuel and the first supply of oxidant are converted to partially-oxidized products, specifically, a synthesis gas comprising hydrogen and carbon monoxide. A suitable partial oxidation catalyst comprises at least one metal of Group VIII of the Periodic Table of the Elements, including iron, cobalt, nickel, ruthenium, rhodium, palladium, osmium, iridium, platinum, and mixtures thereof. The deposition of the Group VIII metal(s) onto the porous substrate is implemented by methods well known in the art. Alternatively, finished catalysts comprising Group VIII metal(s) supported on the MICROLITH brand mesh substrate are available from Precision Combustion, Inc., North Haven, Conn.

In the reforming process, in one embodiment, the porous substrate supporting the partial oxidation catalyst is initially heated using a commercial ignition device, for example a resistive glow plug heating element, disposed within the partial oxidation reactor in close proximity to the substrate. The hydrocarbon fuel fed to the partial oxidation reactor is likewise heated via the ignition device. The ignition device is energized until temperature sensors located within the partial oxidation reactor indicate a temperature sufficient to initiate catalytic activity ("light-off temperature"). Once the catalyst is ignited, the ignition device is de-energized, and energy from the resulting exothermic partial oxidation reaction sustains catalytic operation without a need for inputting external heat. The ignition device allows for start-up from cold or ambient fuel conditions without a need for a fuel vaporizer or other external source of heat.

The porous heat spreader of the deep oxidation reactor comprises any porous solid material that is capable of retaining thermal energy and supporting combustion therein. In one preferred embodiment, the porous heat spreader comprises a foam matrix constructed of a plurality of struts defining a plurality of open-celled pores and channels. For this invention, the porous heat spreader should be sufficiently durable to withstand prolonged periods at operating temperatures ranging up to about 1,400° C. Accordingly, the porous heat spreader is suitably provided as a metallic, ceramic, or cermet composition appropriate to the operating temperatures. Metallic heat spreaders can be constructed, for example, from iron-chromium alloys, including FeCrAlY iron-chromium alloys or similar iron-chromium-aluminum alloys, examples of such alloy materials being described hereinabove. Ceramic heat spreaders can be constructed, for example, from alumina, aluminosilicates, and mullite, examples of such ceramic materials being described hereinabove as well. Cermets comprise a combination of the suitable ceramic material with the suitable metallic material. In one embodiment, the foam matrix has a regular or periodic distribution of like-sized open-cells. In another embodiment, the porous heat spreader, preferably the foam matrix, has an irregular or asymmetric distribution of different-sized cells winding through the strut structure in serpentine fashion. Typically, the porous heat spreader has a pore density ranging from about 10 to about 30 pores per inch (10-30 ppi).

In one embodiment the premixer comprises an open-spaced plenum, more specifically, an open-spaced plenum absent a foam matrix. In this embodiment, the premixer plenum functions to mix the partial oxidation products and the incoming secondary supply of oxidant, and thereafter combust the resulting mixture in a diffusion flame within the plenum. The combustion is lean based on employing an excess of secondary supply of oxidant relative to partial oxidation product, thereby resulting in complete conversion of the partial oxidation products, namely carbon monoxide and hydrogen, to deep oxidation products of carbon dioxide and water. Heat from the combustion flame is transferred downstream to the porous heat spreader, wherein the heat is transferred radially inwardly to any associated heat acceptor. In another exemplary embodiment, a distribution plate (FIG. 1/16) comprising a flat metal plate having a plurality of holes is disposed within the plenum near the outlet (FIG. 1/40) of the partial oxidation reactor (FIG. 1/8) and upstream of the secondary oxidant inlet (FIG. 1/20). The distribution plate functions to retard flashback into the POX reactor, while also mixing the flows of the partial oxidation product and the secondary oxidant at a location within the premixer plenum desirable for flame positioning.

In another embodiment, the premixer plenum is filled partially or completely with a foam matrix of a higher pore density as compared with the pore density of the porous heat spreader (e.g., the foam matrix heat spreader). Typically, the foam matrix disposed within the premixer plenum has a pore density ranging from greater than about 60 pores per inch (60 ppi) to about 100 ppi. The premixer plenum containing the high-pore density foam matrix functions to provide improved mixing of the partial oxidation product with the secondary supply of oxidant. Moreover, in this instance combustion of the partial oxidation product is forced downstream into the porous heat spreader. If employed, the foam matrix disposed within the premixer plenum is suitably constructed from any of the heat spreader materials described hereinbefore, such as the iron-chromium alloys (FeCrAlY). Other suitable materials of construction include ceramic foams, such as, mullite aluminosilicate.

The hydrocarbon fuel fed to the partial oxidation reactor is selected from any gaseous or liquid hydrocarbon fuel capable of being converted into a syngas mixture comprising carbon monoxide and hydrogen. Suitable gaseous hydrocarbon fuels include, without limitation, methane, natural gas, ethane, propane, butane, ethylene, propylene, fuel gas, bio fuel gas, and mixtures thereof; methane and natural gas being preferred. Suitable liquid hydrocarbon fuels include, without limitation, gasoline, kerosene, diesel, jet propulsion fuels, such as Jet A and Jet X, biomass fuels, and synthetic fuels obtained from Fisher-Tropsch processes.

The first supply of oxidant fed to the partial oxidation reactor comprises any chemical capable of partially oxidizing the hydrocarbon fuel selectively to a gaseous partial oxidation product comprising hydrogen and carbon monoxide (syngas). Suitable oxidants include, without limitation, essentially pure molecular oxygen, mixtures of oxygen and nitrogen, such as air, and mixtures of oxygen with one or more inert gases, such as helium and argon.

The hydrocarbon fuel and first supply of oxidant are provided to the partial oxidation reactor in a "fuel-rich" ratio such that there is insufficient amount of oxidant present to convert all of the fuel to complete oxidation products of carbon dioxide and water. The quantities of first supply of oxidant and hydrocarbon fuel are best described in terms of an O:C ratio, wherein "O" refers to atoms of oxygen in the first supply of oxidant and "C" refers to atoms of carbon in the hydrocarbon fuel. Generally, the O:C ratio of oxidant to hydrocarbon fuel fed to the POX reactor is greater than about 0.5:1 and less than about 1.2:1.

The reforming process desirably involves contacting the hydrocarbon fuel and the first supply of oxidant in the absence of co-fed external water, steam or mixture thereof. In this instance, the term "co-fed external water, steam or mixture thereof" refers to co-feeding, with the supplies of hydrocarbon fuel and first supply of oxidant, a supply of water, steam, or such mixture thereof as is imported from an external source, for example, an on-board water tank or steam generator or vaporizer. While this application broadly does not prohibit co-feeding water and/or steam to the reforming process, and while partial oxidation product yields can be enhanced by the addition of co-fed water and/or steam, in the present process co-feeding external water and/or steam might add an unnecessary burden.

The reforming process typically operates at a temperature greater than about 700° C. and less than about 1,100° C. and a pressure ranging from sub-ambient to about 1 psig (6.9 kPa). A suitable gas hourly space velocity measured at 21° C. and 1 atm (101 kPa) ranges from about 10,000 liters of combined supply of hydrocarbon fuel and first supply of oxidant per liter of catalyst bed volume per hour (10,000 $hr^{-1}$) to about 750,000 $hr^{-1}$ which allows for high throughput. A reforming efficiency of greater than about 75 percent and, preferably, greater than about 80 percent relative to equilibrium is achievable. The partial oxidation reactor is capable of operating for greater than about 1,000 hours essentially without indications of coke production and catalyst deactivation.

The partial oxidation product exiting the POX reactor is passed into the premixer plenum where the product is supplemented with the second supply of oxidant fed through the second oxidant inlet. The second supply of oxidant supplied to the premixer comprises any chemical capable of fully combusting the partial oxidation product to complete combustion products of carbon dioxide and water, such chemicals to include air and essentially pure oxygen. In one exemplary embodiment, the first and second supplies of oxidants are identical, and preferably, comprise air. If desired, however, the first supply of oxidant supplied to the POX reactor may be different from the second supply of oxidant supplied to the premixer plenum. The partial oxidation product and second supply of oxidant are provided in quantities sufficient to convert the partial oxidation product (hydrogen, carbon monoxide, and any unconverted hydrocarbon fuel) completely to carbon dioxide and water. Such quantities refer to a "fuel-lean" condition wherein the quantity of second supply of oxidant exceeds a stoichiometric ratio that balances the combustion reaction.

Temperatures within the deep oxidation reactor range from 950° C. to about 1,400° C. Heat of combustion is transferred to a heat acceptor disposed in contact with or in close proximity to the porous heat spreader, reducing the temperature of the exhausting combustion gases to a range between about 250° C. and about 350° C. In one exemplary embodiment, the exhausting combustion gases are passed through a recuperator structure (FIG. 2-30/34/20) to further cool the combustion gases and heat the incoming second supply of oxidant.

"Superficial velocity" is defined as the standardized volumetric flowrate (equivalent volumetric flow of gas at 0° C. and 1 bar) through the heat spreader matrix divided by cross-sectional area of the heat spreader matrix perpendicular to direction of flow. An optimal superficial velocity is dependent upon operating temperature, inlet gas composition and combustion stoichiometry. In order to maintain combustion within the heat spreader matrix, it was found experimentally that a "superficial velocity" of the gas flowing through the heat spreader matrix is best maintained from about 20 cm/s to about 60 cm/s. At lower velocities, the gas may combust at the entry region of the matrix. At higher velocities, the gas may combust downstream of the matrix. Space velocity through the heat spreader matrix, defined as combined flows of reformate (obtained from the partial oxidation reactor) and second supply of oxidant per unit of matrix volume per standard conditions of 21° C. and 1 atm (101 kPa), is maintained in a range from about 10,000 $hr^{-1}$ to about 50,000 $hr^{-1}$. Optimal heat transfer into the heat acceptor occurs when the combustion is distributed evenly throughout the heat spreader matrix.

EMBODIMENTS

Example 1

An apparatus was constructed to test the efficiency of combustion and heat transfer from the deep oxidation reactor component of the instant apparatus invention to a heat acceptor simulating a heater head of a Stirling engine. With reference to the process schematic of FIG. 3, pressurized cylinders of carbon monoxide (CO) and hydrogen ($H_2$) were connected to mass flow controllers (MFC) that metered quantities of CO and $H_2$, respectively, into an inlet line, which fed the resulting mixture into a deep oxidation reactor (burner). The feed mixture of CO and $H_2$ simulated a synthesis gas obtained from a POX reactor. The deep oxidation reactor/burner had disposed therein a porous foam matrix heat spreader (Metpore® brand iron-chromium alloy, SELEE Corp., density 15 percent) provided in the shape of an annulus (36 mm inner dia., 70 mm outer dia., 13 mm length). Pressurized cylinders of nitrogen ($N_2$) and air were hooked up to mass flow controllers (MFC). A metered mixture of $N_2$ and air obtained therefrom simulated the second oxidant that would be fed to the premixer plenum of the apparatus invention. The mixture of $N_2$ and air was preheated in a heater and fed to the burner. The CO/$H_2$ mixture and the preheated mixture of air/$N_2$ were combusted in the foam matrix under fuel-lean conditions generating complete oxidation products of carbon dioxide ($CO_2$) and water ($H_2O$), which exited the foam matrix through a burner exhaust port.

A metal test bar was positioned within the annulus of the foam matrix heat spreader. The top of the metal test bar was positioned in solid-to-solid contact with the heat spreader. The bottom of the test bar extended beyond the downstream end of the heat spreader. A water line brought water into thermal contact with the lower end of the test bar for cooling purposes. Thermocouples were placed on the heat spreader and along the test bar at its head (high top), top (lower top), mid-section, and bottom section. FIG. 4 presents a graph of temperature versus time measured at each thermocouple. It was found that while the porous heat spreader maintained a combustion temperature of about 900° C. throughout the test, the head temperature at the test bar held at 700° C., with a peak of 745° C. Temperatures measured at the lower top, mid and bottom sections of the test bar were less than 700° C. as expected. Heat flux was acceptable, as up to 368 watts thermal energy was transferred to the test bar.

Example 2

A full scale two-stage combustor was constructed and tested in accordance with this invention. The combustor featured all components of the design illustrated in FIG. 1, including the heat recuperation design shown in FIG. 2. The constructed apparatus included a housing 2 having disposed therein: a Stage 1 catalytic POX reactor 3 comprised of a fuel inlet 4 for inputting natural gas, an oxidant inlet 6 for inputting air, a partial oxidation reaction zone 8 comprising a MICROLITH brand ultra-short-channel-length metal substrate 12 having a rhodium catalyst 14 supported thereon (Precision Combustion, Inc.), and a partial oxidation reactor outlet 40; and a Stage 2 deep oxidation reactor 5 comprising a premixer plenum 18 fluidly connected to the partial oxidation reactor outlet 40, the plenum 18 having disposed therein an open-celled metal foam matrix (Metpore® brand FeCrAlY iron-chromium alloy, 100 ppi, SELEE Corp.) (not illustrated). Downstream of the premixer plenum 18 was disposed a heat spreader 28 consisting of an open-celled metal foam heat spreader matrix (Metpore® brand FeCrAlY iron-chromium alloy, 20 ppi, SELEE Corp.) provided in an annular shape of inner diameter 24 (6.91 cm) and outer diameter 26 (10.85 cm) and length (5.7 cm); and a deep oxidation reactor outlet 30 sharing a thermally conductive wall 34 with the inlet 20 of the secondary supply of oxidant.

The two-stage combustor 10 was tested with up to 3.4 kWth natural gas input as fuel to the partial oxidation reactor. Air was employed to both the primary oxidant inlet 6 of the partial oxidation reactor 3 and the secondary oxidant inlet 20 to the premixer plenum 18. The partial oxidation reactor zone 8 was operated at a fuel-rich O:C ratio sufficient to maintain a temperature of 950° C., providing for a partial oxidation product composition comprising hydrogen and carbon monoxide. The deep oxidation reactor 5 was operated lean, with excess air relative to partial oxidation product so as to provide for complete conversion of partial oxidation product to $CO_2$ and $H_2O$. The combustion within the deep oxidation reactor 5 was flameless, with no detectable emissions of NOx or hydrocarbons.

A metallic test bar simulating a heat acceptor was placed within the cylindrical space 25 defined by the inner diameter 24 of the heat spreader 28, in solid-to-solid contact with the heat spreader. Under operation at 3.4 kWth input of natural gas to the partial oxidation reactor, the temperature of the test bar increased to 822° C. providing proof of concept.

Thereafter, the metallic test bar was removed and the metal foam matrix heat spreader 28 was brazed onto the heater head of a Stirling engine. The resulting heat spreader-heater head combination was positioned within the housing 2 as illustrated in FIG. 1, disposed as foam matrix heat spreader 28 and Stirling engine heater head within cylindrical space 25. The partial oxidation reactor and deep oxidation reactor were operated in the manner described hereinabove with the results shown in a graph depicted in FIG. 5. At a natural gas input to the partial oxidation reactor of 2.5 kilowatts thermal ("Qin") and a temperature of about 720° C. at the inlet to the deep oxidation combustor ("Inlet"), the top of the heater head of the Stirling engine reached a temperature of 650° C. ("Thead"). The Stirling engine generated 500 watts electricity.

While the invention has been described in detail in connection with only a limited number of embodiments, it should be readily understood that the invention is not limited to such disclosed embodiments. Rather, the invention can be modified to incorporate any number of variations, alterations, substitutions, or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A two-stage combustor comprising:

(a) a partial oxidation reactor comprising the following components:

(i) a fuel inlet, (ii) a first oxidant inlet, (iii) a reaction zone comprising a porous substrate having a partial oxidation catalyst supported thereon, the reaction zone disposed in fluid communication with the fuel and first oxidant inlets, and (iv) an outlet fluidly connected to the reaction zone; and (b) a deep oxidation reactor comprising the following components:

(i) a premixer plenum having an upstream end and a downstream end; wherein at the upstream end the premixer plenum is fluidly connected to the outlet of the partial oxidation reactor; and further wherein the premixer plenum comprises a second oxidant inlet; wherein under operating conditions a deep combustion occurs in the premixer plenum under diffusion flame conditions;

(ii) a porous heat spreader having an upstream end and a downstream end; wherein at the upstream end the heat spreader is fluidly connected to the downstream end of the premixer plenum; the porous heat spreader being capable of retaining combustion therein and transmitting heat to a heat acceptor; and (iii) an outlet pathway fluidly connected to the downstream end of the heat spreader.

2. The two-stage combustor of claim 1 wherein the porous substrate comprises a metal mesh substrate having an ultra-short-channel-length ranging from 25 microns to 500 microns.

3. The two-stage combustor of claim 1 wherein the partial oxidation catalyst comprises at least one noble metal of Group VIII of the Periodic Table.

4. The two-stage combustor of claim 1 wherein the premixer plenum further comprises a distribution plate containing a plurality of holes or channels.

5. The two-stage combustor of claim 4 wherein other than the distribution plate, the premixer plenum is empty and does not contain a foam matrix.

6. The two-stage combustor of claim 1 wherein the premixer plenum further comprises a foam matrix having from 60 to 100 pores per inch.

7. The two-stage combustor of claim 1 wherein the heat spreader comprises a foam matrix having from 10 to 30 pores per inch.

8. The two-stage combustor of claim 1 wherein the heat spreader comprising the foam matrix does not support a catalyst.

9. The two-stage combustor of claim 1 wherein the heat spreader comprising the foam matrix supports a catalyst.

10. A two-stage combustor comprising a housing having disposed therein:

(a) a partial oxidation reactor comprising the following components:

(i) a fuel inlet for feeding a hydrocarbon fuel into a reaction zone, (ii) a first oxidant inlet for feeding a first supply of an oxidant into a reaction zone, (iii) a reaction zone comprising a mesh substrate having an ultra-short-channel-length and having a partial oxidation catalyst supported thereon; the reaction zone being disposed in fluid communication with the fuel inlet and the first oxidant inlet; and (iv) an outlet fluidly connected to the reaction zone for exhausting a partial oxidation reaction product; and (b) a deep oxidation reactor comprising the following components:

(i) a premixer plenum having an upstream end and a downstream end; wherein at the upstream end the premixer plenum is fluidly connected to the outlet of the reaction zone; and further wherein the premixer plenum comprises a second oxidant inlet for feeding a second supply of an oxidant into the premixer plenum; wherein the premixer plenum contains a foam matrix of metallic or ceramic composition having a higher pore density than a pore density of the foam matrix of the heat spreader;

(ii) a heat spreader having an upstream end and a downstream end; wherein at the upstream end the heat spreader is fluidly connected to the downstream end of the premixer plenum; and further wherein the heat spreader comprises a metal foam matrix provided in an annular shape defined by an inner diameter and an outer diameter; and (iii) an outlet pathway fluidly connected to the downstream end of the heat spreader for exhausting a gaseous combustion product.

11. The two-stage combustor of claim 10 therein under operating conditions a deep combustion occurs in the premixer plenum under diffusion flame conditions.

12. The two-stage combustor of claim 10 wherein under operating conditions a deep combustion occurs flamelessly within the porous heat spreader.

13. The two-stage combustor of claim 10 wherein the deep oxidation reactor does not contain a catalyst.

14. The two-stage combustor of claim 10 wherein a heat acceptor is disposed within a spatial volume defined and bounded by the inner diameter of the annular heat spreader.

15. The two-stage combustor of claim 14 wherein the heat acceptor comprises a heater head of a Stirling engine.

16. An improved Stirling engine constructed of a piston undergoing reciprocating linear motion within an expansion cylinder containing a working fluid, wherein the working fluid is heated through a heater head, the improvement comprising:

disposing the heater head in thermal communication with the heat spreader of the two-stage combustor of claim 10, so as to generate heat and transfer said heat from the combustor to the heater head.

17. A process of combusting a hydrocarbon in a two-stage combustor, comprising:

(a) in a partial oxidation reactor, contacting a hydrocarbon fuel and a first oxidant with a reforming catalyst supported on a porous substrate under fuel-rich conditions sufficient to produce a product mixture comprising hydrogen and carbon monoxide;

(b) passing the product mixture into a premixer plenum where the product mixture is charged with a second oxidant to form a fuel-lean combustion mixture;

(c) combusting the fuel-lean combustion mixture in a foam matrix heat spreader under fuel-lean conditions sufficient to form carbon dioxide and water and heat of reaction; wherein the fuel-lean combustion mixture has a superficial velocity through the foam matrix heat spreader ranging from 20 cm/sec to 60 cm/sec.

18. The process of claim 17 wherein the foam matrix heat spreader contains from 10 to 30 pores per inch.

19. A process of combusting a hydrocarbon in a two-stage combustor, comprising:

(a) in a partial oxidation reactor, contacting a hydrocarbon fuel and a first oxidant with a reforming catalyst supported on a porous substrate under fuel-rich conditions sufficient to produce a product mixture comprising hydrogen and carbon monoxide;

(b) passing the product mixture into a premixer plenum where the product mixture is charged with a second oxidant to form a fuel-lean combustion mixture;

(c) combusting the fuel-lean combustion mixture in a foam matrix heat spreader under fuel-lean conditions sufficient to form carbon dioxide and water and heat of reaction; wherein the fuel-lean combustion mixture has a velocity ranging from 10,000 $hr^{-1}$ to 50,000 $hr^{-1}$ through the foam matrix heat spreader.

* * * * *